US010658106B2

(12) United States Patent
Yamada et al.

(10) Patent No.: US 10,658,106 B2
(45) Date of Patent: May 19, 2020

(54) STATIONARY INDUCTION ELECTRICAL APPARATUS

(71) Applicant: HITACHI, LTD., Tokyo (JP)

(72) Inventors: Youichirou Yamada, Tokyo (JP); Akira Nishimizu, Tokyo (JP); Yoshio Hamadate, Tokyo (JP); Akira Yamagishi, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 130 days.

(21) Appl. No.: 15/683,104

(22) Filed: Aug. 22, 2017

(65) Prior Publication Data

US 2018/0068785 A1 Mar. 8, 2018

(30) Foreign Application Priority Data

Sep. 2, 2016 (JP) ..... 2016-171376

(51) Int. Cl.

| | |
|---|---|
| ***H01F 30/12*** | (2006.01) |
| ***H01F 38/08*** | (2006.01) |
| ***H01F 3/02*** | (2006.01) |
| ***H01F 3/12*** | (2006.01) |
| ***H01F 3/14*** | (2006.01) |

(52) U.S. Cl.

CPC ..... *H01F 30/12* (2013.01); *H01F 3/02* (2013.01); *H01F 3/12* (2013.01); *H01F 3/14* (2013.01); *H01F 38/08* (2013.01)

(58) Field of Classification Search

CPC ..... H01F 3/12; H01F 30/12; H01F 3/02

USPC ..... 336/229

See application file for complete search history.

(56) References Cited

U.S. PATENT DOCUMENTS

| | | | | |
|---|---|---|---|---|
| 3,366,907 A * | 1/1968 | Tipton | H01F 27/303 | 336/197 |
| 6,512,438 B1 * | 1/2003 | Yoshinori | H01F 17/062 | 336/178 |
| 6,531,946 B2 * | 3/2003 | Abe | H01F 17/062 | 29/605 |
| 9,959,968 B2 * | 5/2018 | Kuroda | H01F 3/10 | |

FOREIGN PATENT DOCUMENTS

JP 02-148811 A 6/1990

* cited by examiner

*Primary Examiner* — Ronald Hinson

(74) *Attorney, Agent, or Firm* — Volpe and Koenig, P.C.

(57) ABSTRACT

To provide a safe stationary induction electrical apparatus that prevents a fragment coming off a magnetic shield, wound around an iron core leg portion of the stationary induction electrical apparatus, due to vibrations from being released in a tank accommodating the stationary induction electrical apparatus and thus prevents a trouble such as dielectric breakdown. Moreover, to provide a stationary induction electrical apparatus that does not need to be changed in the dimensions of an iron core for securing an insulation distance due to the placement of a magnetic shield and can reduce a compressive force generated in a winding. A magnetic material is provided in the interiors of insulating members whose interiors are hollow and which are provided in the vicinities of upper and lower ends of the winding wound around the iron core leg portion of the stationary induction electrical apparatus.

7 Claims, 8 Drawing Sheets

[FIG. 1]
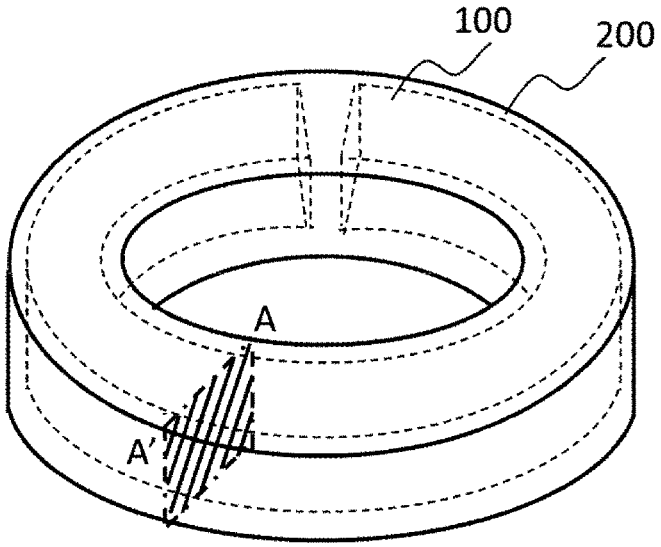
[FIG. 2]
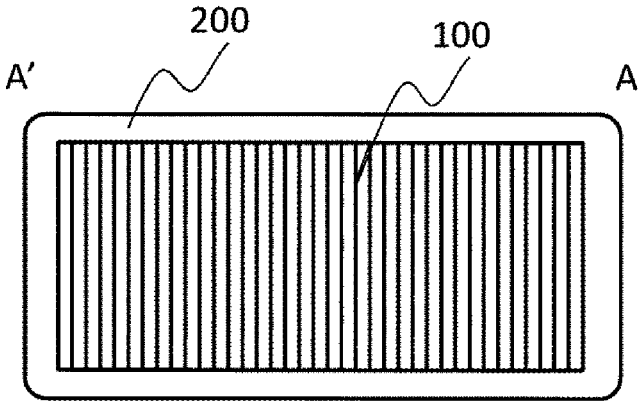

[FIG. 3]
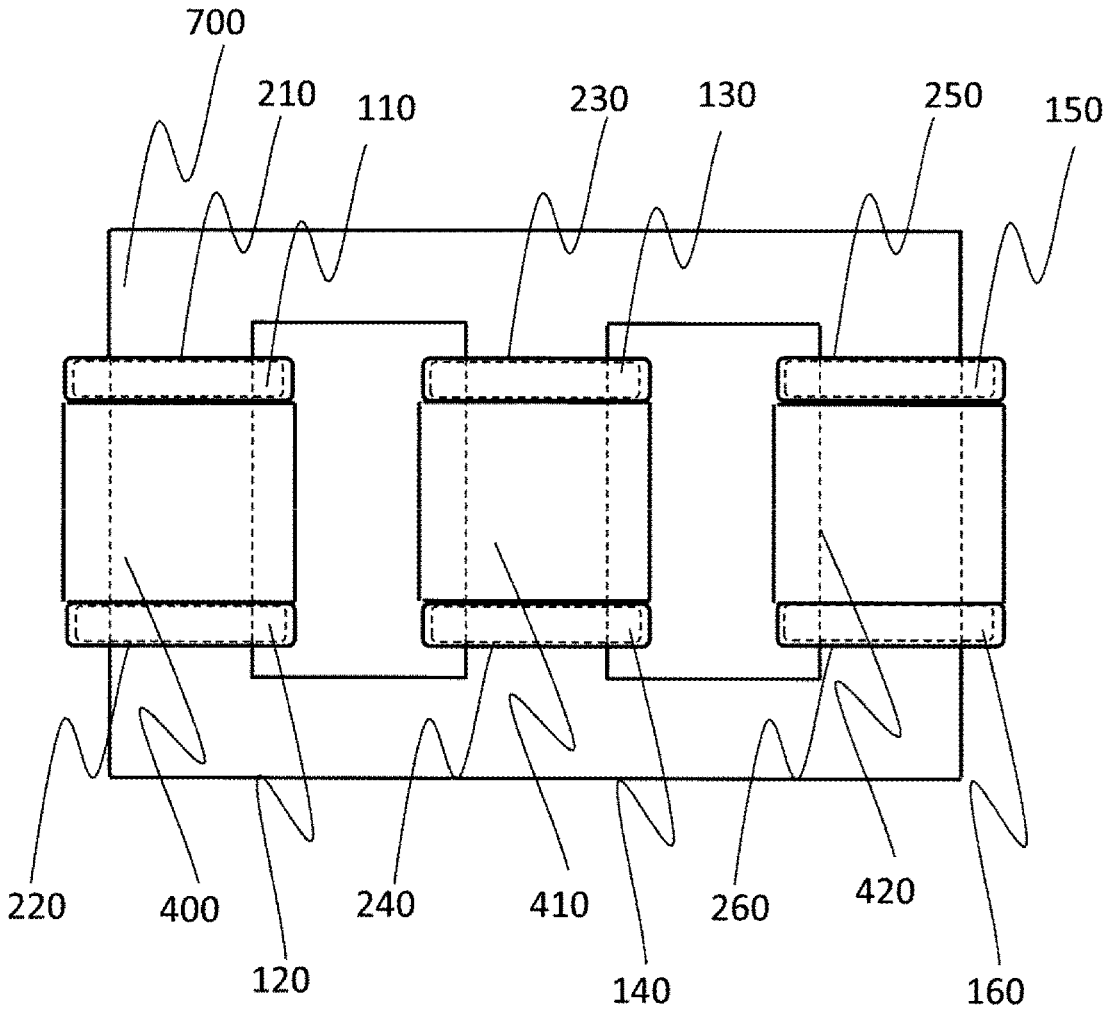

[FIG. 4]
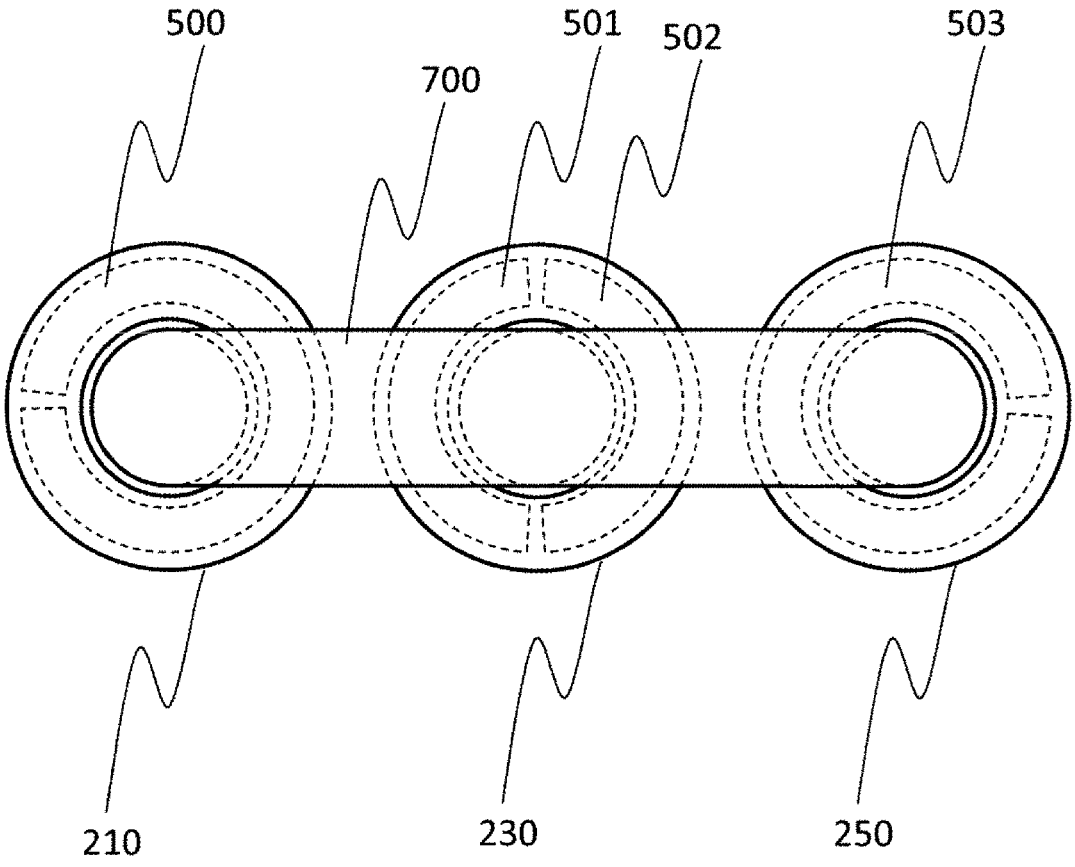

[FIG. 5]
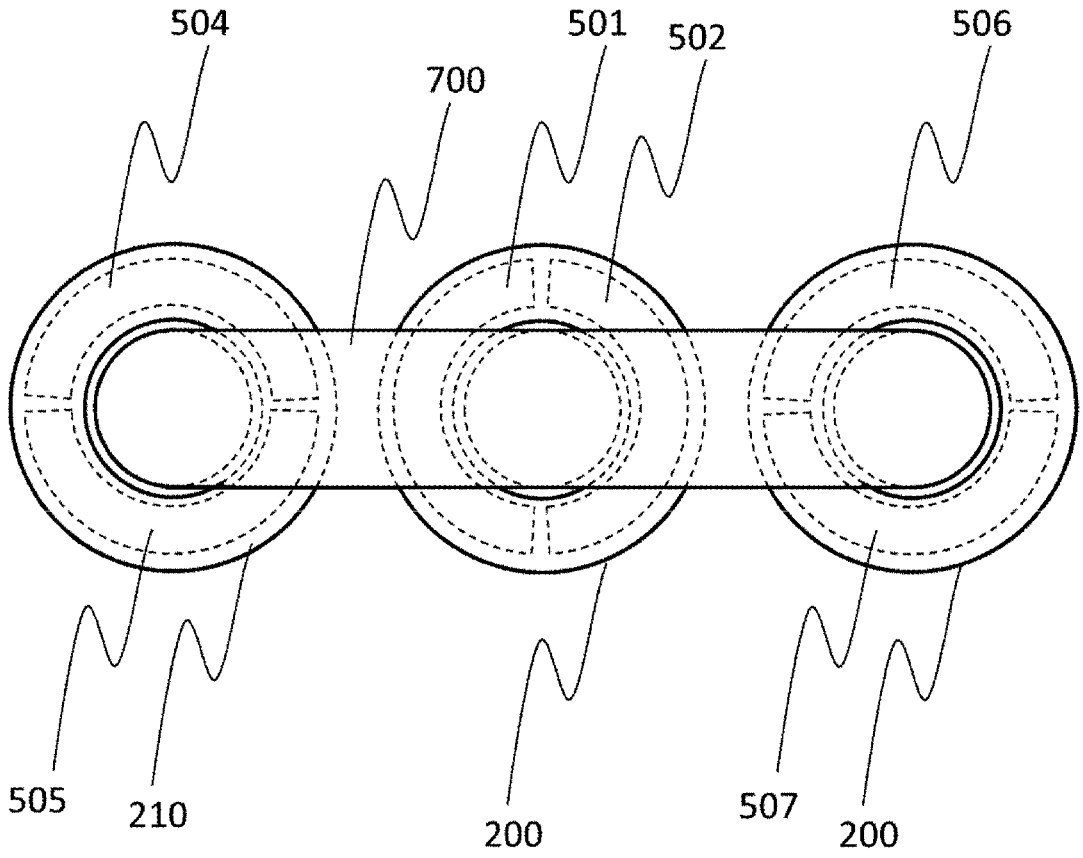

[FIG. 6]
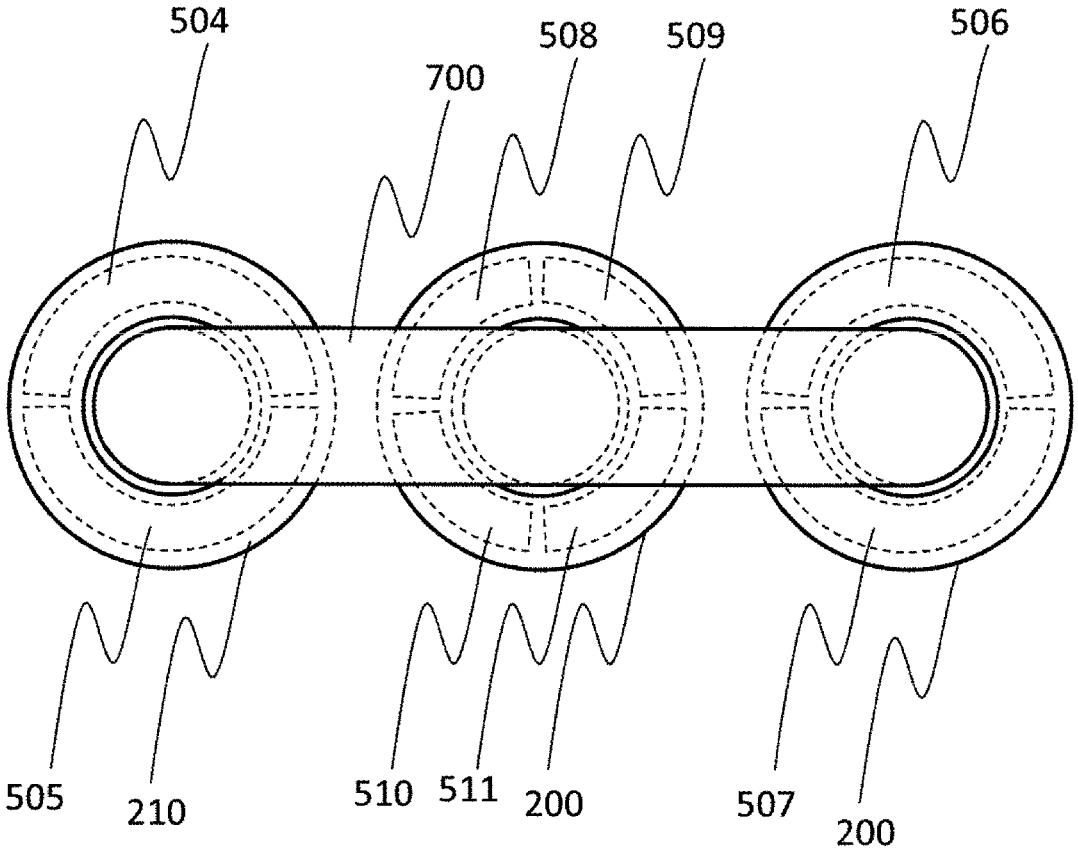

[FIG. 7]
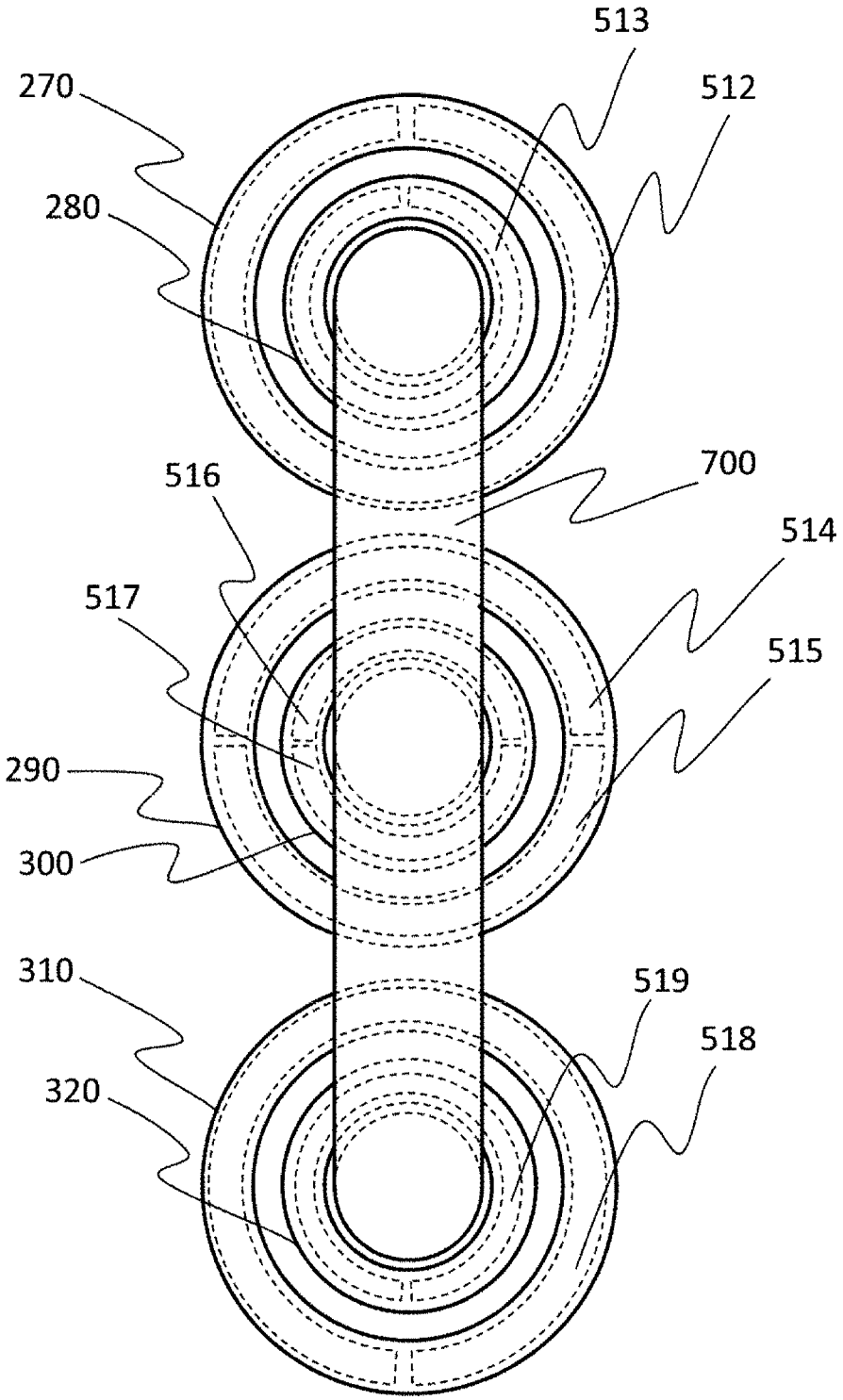

[FIG. 8]
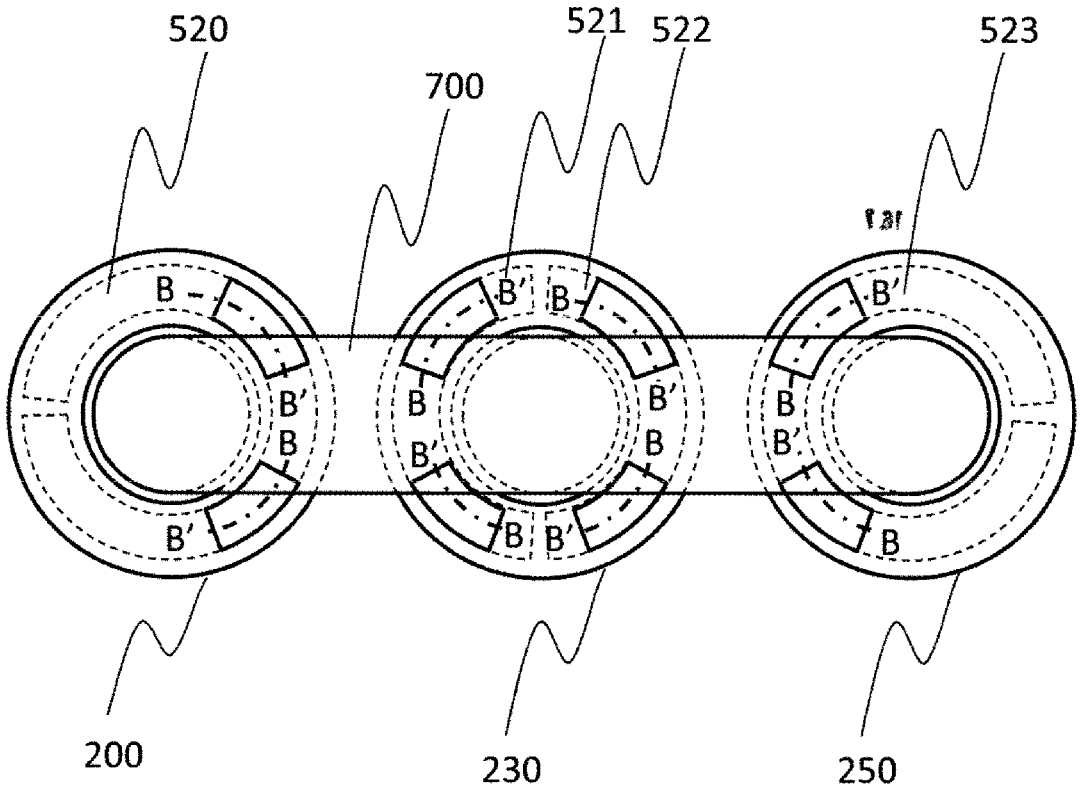
[FIG. 9]
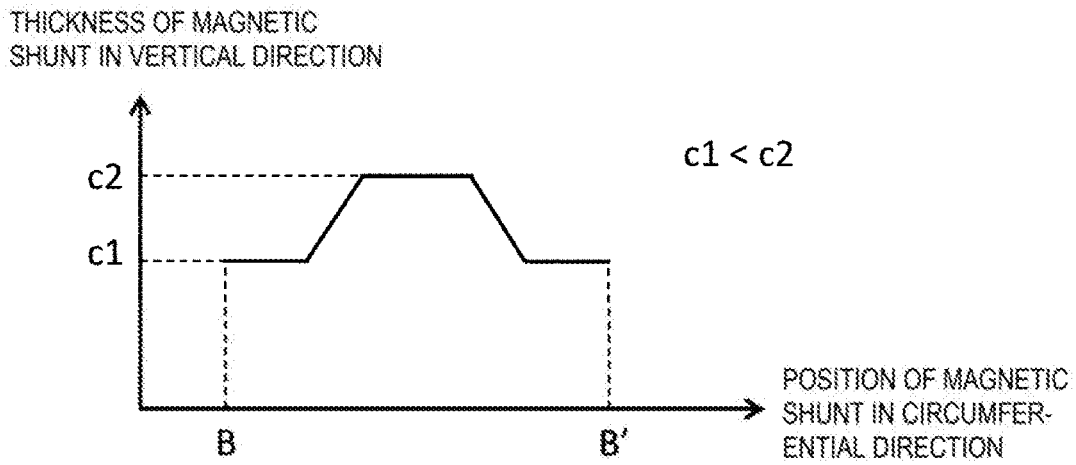

[FIG. 10]
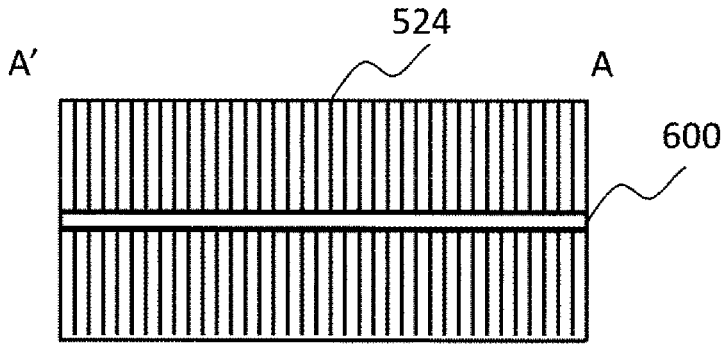

STATIONARY INDUCTION ELECTRICAL APPARATUS

CLAIM OF PRIORITY

The present application claims priority from Japanese Patent application serial No. 2016-171376, filed on Sep. 2, 2016, the content of which is hereby incorporated by reference into this application.

TECHNICAL FIELD

The present invention relates to the structure of a stationary induction electrical apparatus.

BACKGROUND ART

In a stationary induction electrical apparatus, such as a transformer or a reactor, including: an iron core including a leg portion and yoke portions; and one or more windings wound around the leg portion of the iron core and concentrically disposed with an insulation distance between the upper and lower yoke portions, measures to reduce adverse effects due to leakage magnetic flux passing through the winding have been conventionally taken.

For example, PTL 1 discloses a stationary induction electrical apparatus including an annular disc-shaped magnetic shield formed by winding a silicon steel sheet strip in a disc shape and stacked in the radial direction of a winding, in which a magnetic shunt formed of a high magnetic permeability material so as to induce a portion of leakage magnetic flux in the radial direction of the winding is provided on the surface of the magnetic shield on the side opposite to the surface thereof facing the winding.

CITATION LIST

Patent Literature

PTL 1: JP-A-2-148811

SUMMARY OF INVENTION

Technical Problem

Since the leakage magnetic flux passing through the winding spreads in the radial direction of the winding at the end of the winding in the stationary induction electrical apparatus, a force to compress the winding in the vertical direction is generated in the winding. On this occasion, if the strength of the winding is not sufficient, a winding portion is broken by the compressive force generated in the winding.

Reducing the compressive force generated in the winding by controlling the direction of the leakage magnetic flux spreading in the radial direction of the winding at the end of the winding in the vertical direction is an effective means for preventing the breakage of the winding by the compressive force in the vertical direction.

Although PTL 1 describes the magnetic shield as a measure against the leakage magnetic flux, the magnetic material such as the silicon steel sheet strip constituting the magnetic shield vibrates due to a magnetostriction phenomenon because of the flow of magnetic flux. Since the stationary induction electrical apparatus is operated for a long time, the magnetic shield continues to vibrate for a long time. For this reason, there is the possibility that a fragment coming off the silicon steel sheet strip due to vibrations with the deterioration of the silicon steel sheet strip over time is released in a tank accommodating the stationary induction electrical apparatus.

Since the fragment released in the tank of the stationary induction electrical apparatus becomes the cause of a trouble such as dielectric breakdown, it is necessary to prevent releasing of the fragment. Moreover, when the magnetic shield is placed at the position described in PTL 1, the dimensions of the iron core need to be increased because it is necessary to provide an insulation distance between the magnetic shunt and the iron core.

In order to solve the problems described above, it is an object of the invention to provide a stationary induction electrical apparatus that prevents a fragment coming off a magnetic sheet strip constituting a magnetic shunt from being released in a tank accommodating the stationary induction electrical apparatus, does not need to be changed in the dimensions of an iron core, and can reduce a compressive force generated in a winding.

Solution to Problem

In the invention, the surfaces of magnetic shunts formed of a magnetic material and provided in the vicinities of upper and lower ends of a winding wound around an iron core leg portion of the stationary induction electrical apparatus are each covered by an insulating member.

Advantageous Effects of Invention

According to the invention, the fragment coming off the magnetic material constituting the magnetic shunt can be prevented by the insulating member covering the magnetic shunt from being released in the tank accommodating the stationary induction electrical apparatus, and a trouble such as dielectric breakdown caused by the fragment can be prevented. Moreover, since the magnetic shunt is covered by the insulating member, insulation between the iron core and the magnetic shunt is secured, and it is unnecessary to change the dimensions of the iron core due to the provision of the magnetic shunt. Moreover, since the direction of the leakage magnetic flux spreading in the radial direction of the winding at the end of the winding can be controlled in the vertical direction by the magnetic shunt, the compressive force generated in the winding can be reduced.

BRIEF DESCRIPTION OF DRAWINGS

FIG. 1 shows an example of a basic configuration schematic view of a magnetic shunt in Embodiment 1.

FIG. 2 is a diagram showing a cross-section A-A' of the magnetic shunt in FIG. 1 and an insulating member.

FIG. 3 is a structure schematic view of a stationary induction electrical apparatus as viewed from the side, showing the placement locations of magnetic shunts in Embodiment 1.

FIG. 4 is a structure schematic view of the stationary induction electrical apparatus in Embodiment 1 as viewed from the top.

FIG. 5 is a structure schematic view of a stationary induction electrical apparatus in Embodiment 2 as viewed from the top.

FIG. 6 is a structure schematic view of a stationary induction electrical apparatus in Embodiment 3 as viewed from the top.

FIG. 7 is a structure schematic view of a stationary induction electrical apparatus in Embodiment 4 as viewed from the top.

FIG. 8 is a structure schematic view of a stationary induction electrical apparatus in Embodiment 5 as viewed from the top.

FIG. 9 is a diagram showing the thickness of a magnetic shunt in the vertical direction on a line B-B' in Embodiment 5.

FIG. 10 is a diagram showing a cross-section A-A' of a magnetic shunt in Embodiment 6.

DESCRIPTION OF EMBODIMENTS

The invention relates to a magnetic shunt of a stationary induction electrical apparatus including: an iron core formed by fastening an iron core leg and an iron core yoke that are formed by stacking steel sheets made of a magnetic material such as metal and an iron core joint portion between the iron core yoke and the iron core leg with a fastening fitting via an insulating material in the stacking direction; and one or more windings, an insulating tube, and a linear spacer that are disposed around the iron core leg with an insulation distance, in which the iron core, the winding, the insulating tube, and the linear spacer are accommodated in a tank that is filled with a cooling insulating medium. The magnetic shunt is for controlling the direction of leakage magnetic flux at the end of the winding to reduce a compressive force in the vertical direction generated in the winding.

Preferred embodiments in carrying out the invention will be described below with reference to the drawings. The following describes merely embodiments, and it is needless to say that the details of the invention are not limited to the following forms.

Embodiment 1

FIG. 1 shows a basic configuration schematic view of a magnetic shunt 100 in Embodiment 1. The magnetic shunt 100 is configured by stacking thin strips of a magnetic substance such as a silicon steel sheet as shown in FIG. 1. On this occasion, the magnetic substance may be configured by stacking thin strips or may be configured as a bulk. When the thin strips are stacked, the effect of suppressing the occurrence of an eddy current is obtained.

By covering the surface of the magnetic shunt 100 with an insulating member 200, insulation of the magnetic shunt 100 is secured, and a fragment coming off the magnetic shunt 100 is prevented from being released in a tank accommodating a stationary induction electrical apparatus. Typical examples of the insulating member include a "crepe paper". Functionally, a "paper-like material that can provide electrical insulation" may suffice. FIG. 2 shows a cross-section A-A' of the magnetic shunt 100 and the insulating member 200.

FIG. 3 is a structure schematic view of a stationary induction electrical apparatus as viewed from the side, showing the placement locations of magnetic shunts. FIG. 3 shows the stationary induction electrical apparatus including three iron core leg portions as an example. Windings 400, 410, and 420 that are wound around the leg portions of an iron core 700 are each configured by at least two or more windings disposed concentrically. Magnetic shunts 110, 120, 130, 140, 150, and 160 that are covered by insulating members 210, 220, 230, 240, 250, and 260, such as shown in FIG. 1, are placed at the upper and lower ends of the windings 400, 410, and 420 so as to cover the windings 400, 410, and 420.

FIG. 4 is a structure schematic view of the stationary induction electrical apparatus in FIG. 3 as viewed from the top, showing an example of the shapes of the magnetic shunts 110, 120, 130, 140, 150, and 160. A magnetic shunt 500 and a magnetic shunt 503 that are wound around the leg portions at both ends of the three leg portions are each provided with a gap at one place of the portion located outside the iron core 700. Moreover, a magnetic shunt that is wound around the leg portion at the center of the three leg portions is provided with gaps at two places located outside the iron core 700 and thus is divided into magnetic shunts 501 and 502. Due to this, leakage magnetic flux flowing from the windings 400, 410, and 420 passes through the magnetic shunts 500, 501, 502, and 503 and efficiently flows into the iron core 700, and the direction of leakage magnetic flux in the vicinities of the upper and lower ends of the windings 400, 410, and 420 can be effectively controlled.

Now, when a magnetic material such as a magnetic shunt is placed by winding the magnetic material around an iron core, it is necessary to cut a portion of the magnetic shunt to provide a gap so that one turn of a magnetic path due to the magnetic shunt is not formed. The cut surface of a silicon steel sheet strip formed at this time is susceptible to vibrations due to a magnetostriction phenomenon compared to other portions of the silicon steel sheet strip. Therefore, since the possibility that a fragment is released from this cut surface in a tank of a stationary induction electrical apparatus is higher, it is particularly effective to prevent the fragment from being released in the tank accommodating the stationary induction electrical apparatus by an insulating member covering the magnetic shunt as in the embodiment.

Although the magnetic shunts placed at the upper ends of the windings 400, 410, and 420 have been described in the embodiment, the magnetic shunts placed at the lower ends of the windings 400, 410, and 420 can also be configured by a method similar to that of the embodiment.

According to the embodiment as described above, the fragment coming off the magnetic material constituting the magnetic shunt can be prevented by the insulating member covering the magnetic shunt from being released in the tank accommodating the stationary induction electrical apparatus, and a trouble such as dielectric breakdown caused by the fragment can be prevented. Moreover, since the magnetic shunt is covered by the insulating member, insulation between the iron core and the magnetic shunt is secured, and it is unnecessary to change the dimensions of the iron core due to the provision of the magnetic shunt. Moreover, since the direction of leakage magnetic flux spreading in the radial direction of the winding at the end of the winding can be controlled in the vertical direction by the magnetic shunt, a compressive force generated in the winding can be reduced.

Embodiment 2

FIG. 5 is a structure schematic view of a stationary induction electrical apparatus in Embodiment 2 as viewed from the top, showing an example of the shapes of magnetic shunts 501, 502, 504, 505, 506, and 507. A basic configuration is similar to that of Embodiment 1; therefore, only portions different from those of Embodiment 1 will be described.

In the embodiment, gaps are provided at two places of each of magnetic shunts that are wound around the leg portions at both ends of the iron core 700, and thus the magnetic shunts are divided into magnetic shunts 504 and 505 and magnetic shunts 506 and 507. Due to this, since the shapes of the magnetic shunts 501, 502, 504, 505, 506, and 507 are the same, manufacturing cost can be reduced.

Although the magnetic shunts placed at the upper ends of the windings 400, 410, and 420 have been described in the embodiment, the magnetic shunts placed at the lower ends of the windings 400, 410, and 420 can also be configured by a method similar to that of the embodiment.

Embodiment 3

FIG. 6 is a structure schematic view of a stationary induction electrical apparatus in Embodiment 3 as viewed from the top, showing an example of the shapes of magnetic shunts 504, 505, 506, 507, 508, 509, 510, and 511. A basic configuration is similar to that of Embodiment 1; therefore, only portions different from those of Embodiment 1 will be described.

In the embodiment, the magnetic shunt that is wound around the leg portion at the center of the iron core 700 is provided with gaps at four places located outside the iron core 700 and located below the yoke portion of the iron core 700. Due to this, since the sizes of the magnetic shunts 508, 509, 510, and 511 wound around the leg portion at the center of the iron core 700 can be reduced, manufacturing cost can be reduced due to a reduction in the amount of material of the magnetic shunts.

Although the magnetic shunts placed at the upper ends of the windings 400, 410, and 420 have been described in the embodiment, the magnetic shunts placed at the lower ends of the windings 400, 410, and 420 can also be configured by a method similar to that of the embodiment.

Embodiment 4

FIG. 7 is a structure schematic view of a stationary induction electrical apparatus in Embodiment 4 as viewed from the top, showing an example of the shapes of magnetic shunts 512, 513, 514, 515, 516, 517, 518, and 519. A basic configuration is similar to that of Embodiment 1; therefore, only portions different from those of Embodiment 1 will be described.

In the embodiment, a stationary induction electrical apparatus in which each of the windings 400, 410, and 420 is configured by two windings disposed concentrically is shown as an example. For convenience sake, the two windings are referred to as an outer winding and an inner winding. In Embodiments 1 to 3, the outer and inner windings constituting each of the windings 400, 410, and 420 wound around the respective leg portions of the iron core 700 are covered by the same magnetic shunt with respect to the radial direction of the winding. In the embodiment, however, the outer and inner windings are configured to be covered by different magnetic shunts.

Details will be described using the shapes of the magnetic shunts of Embodiment 1 as an example. The outer winding constituting the winding 400 is covered by a magnetic shunt 512, and the inner winding is covered by a magnetic shunt 513. The outer winding constituting the winding 410 is covered by magnetic shunts 514 and 515, and the inner winding is covered by magnetic shunts 516 and 517. The outer winding of the winding 420 is covered by a magnetic shunt 518, and the inner winding is covered by a magnetic shunt 519. Due to this, since only the winding portions are covered by the magnetic shunts, manufacturing cost can be reduced due to a reduction in the amount of material of the magnetic shunts.

Although the magnetic shunts placed at the upper ends of the windings 400, 410, and 420 have been described in the embodiment, the magnetic shunts placed at the lower ends of the windings 400, 410, and 420 can also be configured by a method similar to that of the embodiment.

Moreover, even when the magnetic shunts have the shapes described in Embodiments 2 and 3, the outer and inner windings of each of the windings 400, 10, and 420 may be covered by a method similar to that of the embodiment.

Embodiment 5

FIG. 8 is a structure schematic view of a stationary induction electrical apparatus in Embodiment 5 as viewed from the top, showing an example of the shapes of magnetic shunts 520, 521, 522, and 523. The magnetic flux flowing in the circumferential direction in the magnetic shunt is not uniform. The magnetic flux concentrates depending on the location, and the magnetic shunt is magnetically saturated and thus has the possibility that the magnetic shunt cannot sufficiently provide the function of controlling the direction of leakage magnetic flux at the upper and lower ends of the windings 400, 410, and 420. Therefore, there is a method to maintain the function of controlling the direction of the leakage magnetic flux by increasing the thickness of the magnetic shunt in the vertical direction to increase the cross-sectional area at the portion where the magnetic flux concentrates and thus avoiding magnetic saturation. Details will be described using the shapes of the magnetic shunts of Embodiment 1 as an example.

As to the magnetic shunts 520, 521, 522, and 523, the thicknesses of regions in the vertical direction surrounded by, for example, solid lines are increased. FIG. 9 shows the thickness of the magnetic shunt in the vertical direction on a line B-B'. When the thickness of the magnetic shunt in the vertical direction, other than the regions surrounded by the solid lines, is c1, the thickness in the vertical direction is gradually increased to c2 (c1<c2) in the regions surrounded by the solid lines.

Although the magnetic shunts placed at the upper ends of the windings 400, 410, and 420 have been described in the embodiment, the magnetic shunts placed at the lower ends of the windings 400, 410, and 420 can also be configured by a method similar to that of the embodiment.

Moreover, the embodiment may also be applied to Embodiments 1 to 4.

Embodiment 6

FIG. 10 is a diagram showing a cross-section A-A' of a magnetic shunt 524 in Embodiment 6, which is a modification of the magnetic shunt 100 in Embodiment 1. The magnetic shunt 100 is provided with a gap at one or more places with respect to the circumferential direction, so that the formation of one turn of a magnetic path is avoided. However, there is the possibility that one turn of a magnetic path is formed in a cross-section shown in FIG. 10 depending on the thickness of the magnetic shunt in the vertical direction or the location. Therefore, there is a method to avoid the formation of one turn of a magnetic path by providing an insulating member 600 in the magnetic shunt in the cross-section A-A' to divide the magnetic shunt into two parts in the vertical direction. The embodiment may be applied to Embodiments 1 to 5.

Embodiment 7

The shapes of the magnetic shunts provided at the upper and lower ends of each of the windings 400, 410, and 420 are the same in Embodiments 1 to 4. However, the magnetic shunts may have different shapes such that, for example, the shapes of the magnetic shunts provided at the upper ends of the windings 400, 410, and 420 are the shapes of Embodiment 1 and the shapes of the magnetic shunts provided at the upper ends of the windings 400, 410, and 420 are those of Embodiment 2. Due to this, the shape of the magnetic shunt that does not interfere with a structure located above or below the windings 400, 410, and 420 can be selected, and thus the flexibility of layout in the tank accommodating the stationary induction electrical apparatus is increased.

The invention is not limited to the embodiments described above but includes various modified examples. For example, the embodiments described above have been described in detail for clarity of description of the invention, and the invention is not necessarily limited to one including all of the configurations described. Moreover, a portion of the configurations of a certain embodiment can be replaced by configuration of another embodiment, and the configuration of another embodiment can be added to the configuration of a certain embodiment. Moreover, the addition, deletion, and replacement of another configuration can be made to a portion of the configurations of each embodiment.

REFERENCE SIGNS LIST

100, 110, 120, 130, 140, 150, 160, 500, 501, 502, 503, 504, 505, 506, 507, 508, 509, 510, 511, 512, 513, 514, 515, 516, 517, 518, 519, 520, 521, 522, 523, 524: magnetic shunt
200, 210, 220, 230, 240, 250, 260, 270, 280, 290, 300, 310, 320: insulating member
400, 410, 420: winding
600: insulating member in magnetic shunt
700: iron core

The invention claimed is:

1. A stationary induction electrical apparatus comprising:

an iron core including a left leg, a middle leg, a right leg and a yoke portion magnetically coupling the left leg, the middle leg, and the right leg, wherein the left leg, the middle leg and the right leg are formed by stacking steel sheets made of a magnetic material and are aligned along a first axis with the middle leg located between the left leg and right leg;

one or more first windings that are wound around the left leg;

one or more second windings that are wound around the middle leg;

one or more third windings that are wound around the right leg;

a first magnetic shunt located at upper and lower ends of the one or more first windings on the left leg, wherein the first magnetic shunt includes a first radial gap in a circumferential direction of the first magnetic shunt;

a second magnetic shunt located at upper and lower ends of the one or more second windings on the middle leg, wherein the second magnetic shunt includes two second radial gaps in a circumferential direction of the second magnetic shunt; and a third magnetic shunt located at upper and lower ends of the one or more third windings on the middle leg, wherein the third magnetic shunt includes a third radial gap in a circumferential direction of the third magnetic shunt.

2. The stationary induction electrical apparatus according to claim 1, wherein a thickness of each of the first magnetic shunt, the second magnetic shunt and third magnetic shunt in a vertical direction is partially different, wherein the vertical direction is orthogonal to the first axis.

3. The stationary induction electrical apparatus according to claim 1, wherein a distance of at least one or more of the first radial gap, the two second radial gaps and the third radial gap a circumferential direction thereof is from 1.0 mm to 2.0 mm.

4. The stationary induction electrical apparatus according to claim 1, wherein the two second radial gaps are located opposite of each other with respect to the first axis.

5. The stationary induction electrical apparatus according to claim 4, wherein the two second radial gaps are perpendicular to the first axis.

6. The stationary induction electrical apparatus according to claim 1, wherein the first radial gap and the third radial gap are parallel to the first axis.

7. The stationary induction electrical apparatus according to claim 6, wherein the first radial gap is directed away from the middle leg, and wherein the third radial gap is directed away from the middle leg.

* * * * *